United States Patent [19]

Roling et al.

[11] Patent Number: 4,571,003

[45] Date of Patent: Feb. 18, 1986

[54] APPARATUS FOR CONTROLLING THE POSITION OF A MINERAL MINING MACHINE

[75] Inventors: Franz Roling, Nordkirchen; Gerhard Merten; Bernd Steinkuhl, both of Lünen, all of Fed. Rep. of Germany

[73] Assignee: Gewerkschaft Eisenhutte Westfalia, Lunen, Fed. Rep. of Germany

[21] Appl. No.: 568,375

[22] Filed: Jan. 5, 1984

[30] Foreign Application Priority Data

Jan. 7, 1983 [DE] Fed. Rep. of Germany ..... 3300306

[51] Int. Cl.[4] ..... E21D 23/00; E21C 27/32

[52] U.S. Cl. ..... 299/33; 299/64; 299/43; 299/42; 403/56; 403/115; 403/122

[58] Field of Search ..... 299/43, 33, 64; 403/114, 115, 56, 122

[56] References Cited

U.S. PATENT DOCUMENTS

| | | | |
|---|---|---|---|
| 957,984 | 5/1910 | Mowry | 403/114 X |
| 3,210,103 | 10/1965 | Montgomery et al. | 403/115 |
| 4,045,089 | 8/1977 | Hauschopp et al. | 299/43 |
| 4,068,721 | 1/1978 | Trayler | 403/114 |
| 4,186,969 | 2/1980 | Beckmann | 299/43 |
| 4,458,951 | 7/1984 | Merten et al. | 299/43 |
| 4,492,410 | 1/1985 | Schlusener et al. | 299/43 |
| 4,509,799 | 4/1985 | Roling | 403/122 X |

*Primary Examiner*—Stephen J. Novosad
*Assistant Examiner*—Michael Goodwin
*Attorney, Agent, or Firm*—Maurice E. Gauthier

[57] ABSTRACT

Apparatus for controlling the position of a mineral mining machine, such as a coal plough, guided for movement back and forth along a guide employs inclined piston and cylinder units coupled via ball-and-socket joints to brackets on a conveyor supporting the guide and to connectors which are pivotably connected to the conveyor. Assemblies have parallel elongate beams which are guided on roof supports and linked to the connectors. Each connector is of multi-part construction with a main skid resting on the floor of the working and connected to the conveyor and to the associated beams. A further complementary component fits onto the main skid and the parts of the connector have curved recesses which combine to form a socket for receiving a ball of the associated unit.

9 Claims, 3 Drawing Figures

APPARATUS FOR CONTROLLING THE POSITION OF A MINERAL MINING MACHINE

BACKGROUND TO THE INVENTION

The present invention relates in general to mineral mining installations and, more particularly, to apparatus for controlling or adjusting the position of the mineral mining machine movable along guide means.

U.S. Pat. No. 4045089 describes apparatus of the type with which the present invention is concerned. This apparatus takes the form of hydraulic piston and cylinder units coupled between brackets on a conveyor supporting a machine guide and connectors pivotably connected to the conveyor. Elongate beams are then linked to the connectors and are guided on roof supports. Operation of the units causes the conveyor and the guide for the machine to tilt thereby to control the position of a machine, such as a plough, mounted on the guide. During the adjustment, the plough guide pivots with the conveyor about the pivot joints defined between the conveyor and the connectors. The beams serve to guide the associated supports in known manner but also act as jibs in order to support the guide in opposition to the tilting forces. The beams also serve as thrust abutments for the rams associated with the supports.

German patent specification No. 3117401—which corresponds to U.S. Pat. No. 4,492,410—describes another arrangement in which the cylinders of the control units are connected by means of ball-and-socket joints to brackets on the stowage side of the conveyor.

A general object of the invention is to provide an improved apparatus of the aforementioned kind.

SUMMARY OF THE INVENTION

In its broadest aspect the invention provides a connector in the form of a head-piece for linking the conveyor and one or more beams guided on roof support, the head-piece being of a multi-part construction. In a preferred form, the head-piece has a main body which rests on the floor of the working like a skid. This body is pivotably connected to the conveyor, conveniently via a bracket to which an associated piston and cylinder unit is coupled and connected to one or, more preferably, a pair of beams. The other component of the head-piece fits onto the main body and both components have recesses which combine to form a socket receiving a ball of the associated unit thereby to produce a ball-and-socket joint linking the unit to the head-piece. To this end the components of the head-piece, i.e. the main body and the complementary part, may have curved recesses constituting half shells of the socket. The complementary part may have a wedge-shaped or trapezoidal profile fitting between lateral projections or wings on the main body which receive the ends of the associated beams. The complementary part can be small and light and easily assembled and disassembled to the main body. A lug on the latter can project towards the conveyor and receive a pivot pin effecting the pivotal connection between the head-piece and the conveyor.

The main body may have an inclined upper mounting surface on which a similarly inclined lower surface of the complementary part engages. Nuts and bolts can be used to secure the complementary part to the main body in a detachable manner. Alignable bores in the components of the head-piece can then receive the bolts and preferably these bores incline rearwardly away from the conveyor. Recesses in the components can receive the nuts and the heads of the bolts.

In order to prevent excessive rotation of the part of the unit, usually the piston rod, having the ball engaged in the socket of the head-piece, a pin or the like on this ball can engage in a groove in the wall of the socket. Conveniently this groove is provided in the wall of the curved recess of the complementary part and this groove can extend from the mouth of the socket to a lower region thereof. An aperture in the curved recess of the main body can communicate with the groove.

Lateral apertures can also be provided in the wall of the curved recess of the complementary part.

The invention also provides apparatus for controlling the position of the mineral mining machine movable along a guide on one side of a conveyor and comprising bracket means on a side of the conveyor opposite said one side, at least one elongate beam guided for displacement on a roof support, connection means effecting pivotal connection between the conveyor and said beam and at least one inclined piston and cylinder unit connected between the connection means and the bracket means and operable to adjust the position of the guide; wherein the unit is connected to the connection means and to the bracket means with ball-and-socket joints and the connection means takes the form of a multi-part head-piece with a main body for resting on the floor of the mine working and a detachable complementary part, said main body having means for effecting pivotal connection with the bracket means of the conveyor, means for fixing the body to said at least one beam and a curved recess forming part of a socket of one of said ball-and-socket joints and said detachable part having a curved recess which forms the remaining part of said socket.

The invention may be understood more readily, and various other features of the invention may become apparent from consideration of the following description.

BRIEF DESCRIPTION OF DRAWINGS

An embodiment of the invention will now be described by way of example, with reference to the accompanying drawings, wherein.

DESCRIPTION OF PREFERRED EMBODIMENT

Figure 1:
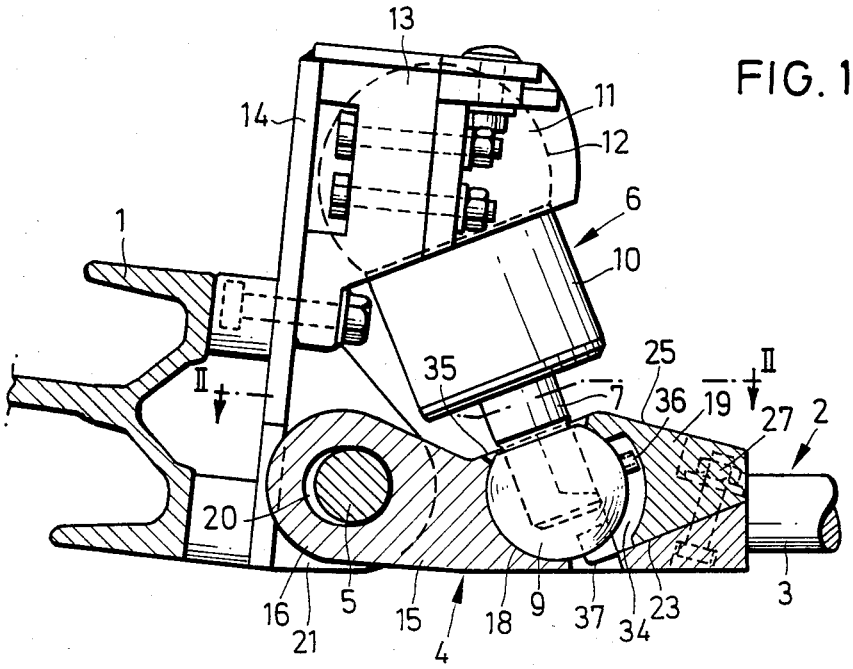
FIG. 1 is a schematic part-sectional side view of part of apparatus constructed in accordance with the invention.
Figure 2:
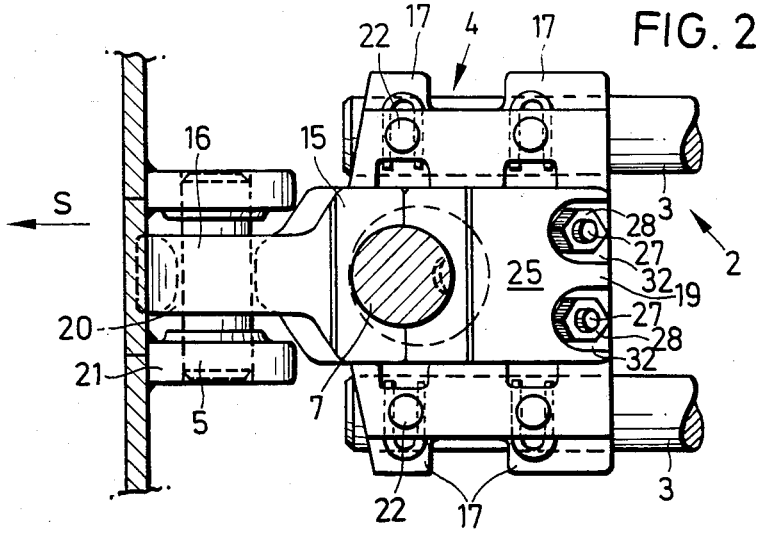
FIG. 2 is a part-sectional plan view of the apparatus as shown in FIG. 1, the view being taken along the line II—II of FIG. 1.

In general, a mineral mining installation employs a scraper-chain conveyor, designated 1 in FIG. 1 disposed alongside a mineral, e.g. coal, face. As is known, the conveyor 1 is composed of a series of channel sections or pans arranged end-to-end. On the mineral face side of the conveyor 1 there is a guide on which a mineral winning machine, such as a plough, is mounted for movement back and forth alongside the mineral face. On the side of the conveyor remote from the mineral face, i.e. on the stowage or goaf side, there are a plurality of supports which support the roof of the mine working. Such supports each have a floor-engaging structure, a roof-engaging structure and hydraulic props mounted between these respective structures. Each support is connected to the conveyor 1 with the aid of a guide assembly part of which is shown in FIGS. 1 and 2 and designated 2. Each guide assembly 2 includes a pair of elongate, parallel, resilient beams 3 interconnected at their ends nearest the conveyor 1 by connection means in the form of a head-piece 4 which rests on the floor of the mine working. The head-piece 4 is itself connected to the conveyor 1 by way of a pivot joint having a pivot pin 5. The beams 3 are also connected at their rear outer ends by means of a transverse yoke or the like which is guided for displacement on the floor-engaging structure of the associated roof support. This rear end connection, as is known per se, also permits the beams 3 to pivot about these rear ends. Each guide assembly 2 also has a shifting ram located between the beams 3. These rams serve to advance the conveyor 1 via the guide assemblies 2 in the direction of arrow S in FIG. 2. Thereafter, the rams can be operated to draw up the associated support as the winning of the mineral progresses. Reference is made to U.S. Pat. No. 4,492,410 and assigned to the same assignee as the present application. This U.S. application, which is incorporated herein by reference, describes one form of the mineral installation and the apparatus described so far.

As shown in FIGS. 1 and 2, a hydraulic piston and cylinder unit 6 is interconnected between each head-piece 4 and a bracket 13 located on the goaf-side of the conveyor 1. These units 6 adopt inclined dispositions and serve to control the position of the guide on the conveyor 1. Each unit 6 has its cylinder 10 connected via a ball-and-socket joint 11, 12 to the associated bracket 13 and its piston rod 7 connected via another ball-and-socket joint 9, 18, 26 to the head-piece 4. The cylinder 10 has a ball 11 while the piston rod 7 has a ball 9. The brackets 13 can be constructed with detachable components forming the socket 12 for the cylinder ball 11 as described in the aforementioned U.S. patent application Ser. No. 373548. The brackets 13 can be of inverted L-shape with upstanding plates 14 fitted to the goaf side walls of the pans of the conveyor as depicted or the brackets 13 can be fixed to such plates 14.

Figure 3:
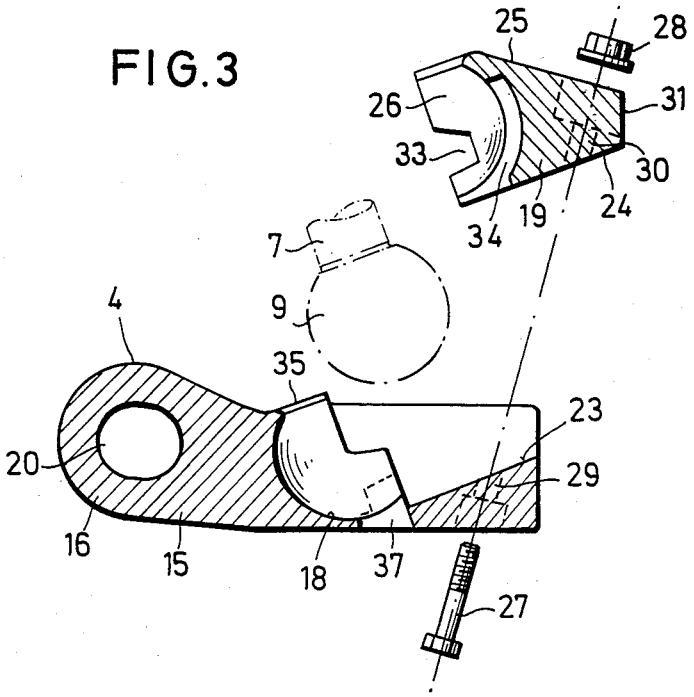
FIG. 3 is an exploded part-sectional representation of a head-piece of the apparatus.

Each head-piece 4 is made of two parts; namely a main body 15 and a secondary part 19. These parts 15, 19 can take the form of castings. The body 15 has a outwardly projecting lug provided with a bore 20 receiving the pivot pin 5 which is engaged in further lugs 21 connected to the conveyor 1 e.g. through the plate 14 or the associated bracket 13. The body 15 also has outwardly projecting transverse wings 17 which receive the beams 3 as shown in FIG. 2. Upstanding pins 22 detachably secure the beams 3 into the wings 17 of the body 15. The body 15 has a curvilinear shaped recess 18 which forms a half shell defining part of the socket for receiving the ball 9 on the piston rod 7 of the unit 6. The other separate part 19 of the head-piece 4 has a complementary curvilinear recess 26 which forms the other half shell, i.e. the remainder of the socket. The walls of the recesses 18, 26 may interengage in a shape-locking configuration (FIG. 3). The body 15 has a depressed region with a inclined rear face 23 to receive the part 19. The latter has a lower surface 24 which seats onto the surface 23. The part 19 also has another top surface 25 which inclines in a different direction to the surface 24 thereby making the part 19 wedge shaped. The surface 25 is recessed at the juncture with a rear face 31 to receive nuts 28 located on bolts 27 inserted through aligned rearwardly-inclined bores 30, 29 in the component parts 15, 19. The heads of the bolts 27 engage in the lower surface of the body 15 and are likewise received in recesses.

The part 19 is also provided with lateral apertures 33 in the shaped recess 26. The wall of the recess 26 also has a groove 34 which extends from the open mouth 35 of the socket 18, 26 to terminate at the bottom in the lower surface 24. The groove 34 is engaged by a pin 36 mounted on the ball 9. The pin 36 locates with the groove 34 to prevent the piston rod 7 from excessive rotation. The body 15 is provided with an aperture 37 in the same position as the end of the groove 34, i.e. at the lowest point of the socket 18, 26.

During assembly, the ball 9 on the piston rod 7 of the control unit 6 is located into the half shell 18 of the body 15 with the part 19 detached. The part 19 is then mounted with its lower surface 24 onto the surface 23 of the body 15 and the nuts and bolts 27, 28 are located and tightened to complete the socket 18, 26 and hold the piston rod 7 to the head-piece 4.

We claim:

1. In apparatus for controlling the position of a mineral mining machine movable along guide means and comprising bracket means connected to said guide means, at least one elongate beam displaceable relative to a roof support, connection means effecting pivotal connection between the guide means and said beam and at least one inclined piston and cylinder unit connected between the connection means and the bracket means and operable to adjust the position of the guide means; the improvements comprising: the unit is connected to the connection means with a ball-and-socket joint, the connection means takes the form of a multi-part head-piece with a main body for resting on the floor of the mine working and a detachable complimentary part, said main body having means for effecting pivotal connection with the guide means, means for fixing the body to said at least one beam, a curved recess in the body forming part of the socket of said ball-and-socket joint and an inclined upper mounting surface on the body which extends to a lower region of the curved recess, and said complimentary part having a curved recess which forms the remaining part of said socket with an inclined lower mounting surface on said complimentary part which is engageable with said inclined surface of the main body, the body and the complimentary part having alignable bores which are inclined away from the bracket means and receive fixing bolts which detachably secure the complimentary part to the main body.

2. Apparatus according to claim 1, wherein the body has an outwardly projecting lug which receives a pivot pin for linking the head-piece to the bracket means and lateral projections at the sides of the curved recess which receive a pair of parallel elongate beams displaceable relative to the roof support.

3. Apparatus according to claim 2, wherein the complementary part engages on the body between said lateral projections.

4. Apparatus according to claim 1, wherein the complementary part has an upper surface which is inclined in an opposite sense to its lower surface.

5. Apparatus according to claim 1, wherein the body and the complimentary part have bores for receiving the heads of said fixing bolts and nuts engaged therewith.

6. Apparatus according to claim 1, wherein the wall of the curved recess in the complementary part has a groove which receives a pin on a ball of the unit engaged in the socket formed by the recesses of the body and the complementary part.

7. Apparatus according to claim 6, wherein said groove extends from the mouth of the socket formed by the recesses of the body and the complementary part to a lower region of said socket.

8. Apparatus according to claim 1, wherein the guide means is provided by a guide on one side of a conveyor and the bracket means is located on a side of the conveyor oposite said one side.

9. Apparatus according to claim 1, wherein the piston and cylinder unit is also connected to the bracket means with a ball-and-socket joint.

* * * * *